United States Patent [19]

Erhardt

[11] Patent Number: 4,460,024

[45] Date of Patent: Jul. 17, 1984

[54] APPARATUS FOR LOOPING METALLIC WIRE OR THE LIKE

[76] Inventor: Gustav Erhardt, Bergstrasse 25, D-6969 Hainstadt, Fed. Rep. of Germany

[21] Appl. No.: 396,614

[22] Filed: Jul. 9, 1982

[30] Foreign Application Priority Data

Dec. 28, 1981 [DE] Fed. Rep. of Germany ... 8137901[U]

[51] Int. Cl.[3] ..... B21F 45/00

[52] U.S. Cl. ..... 140/93 R; 29/525; 29/882

[58] Field of Search ..... 140/105, 93 R, 90; 29/861, 882, 525, 283.5, 818; 72/307

[56] References Cited

U.S. PATENT DOCUMENTS 819,622 5/1906 Watkins et al. ..... 140/90

*Primary Examiner*—Francis S. Husar
*Assistant Examiner*—Linda McLaughlin
*Attorney, Agent, or Firm*—Peter K. Kontler

[57] ABSTRACT

Apparatus for making loops in a metallic wire and for inserting successively formed loops into the pockets of discrete metallic components has a support for a pair of bending pins which define a gap for the passage of a reciprocable deforming ram. A wire feeder supplies a length of wire into and intermittently advances the wire in a channel at one side of the bending pins so that successive increments of the wire move first past one and thereupon past the other of the pins. The ram is movable from that side of the channel which faces away from the pins and into the gap to thereby deform a portion of the wire between successive intermittent actuations of the wire feeder. The other pin is thereupon retracted into its support to allow for movement of the wire in the channel and to thus place a fresh portion of the wire into the path of the ram. A duct stores a stack of metallic components in such positions that the pocket of the lowermost component registers with the gap and can receive a freshly formed loop. Such component is thereupon advanced by a pusher in the direction of intermittent feed of the wire to allow the next-higher component to move its pocket into register with the gap.

13 Claims, 11 Drawing Figures

Fig. 4.
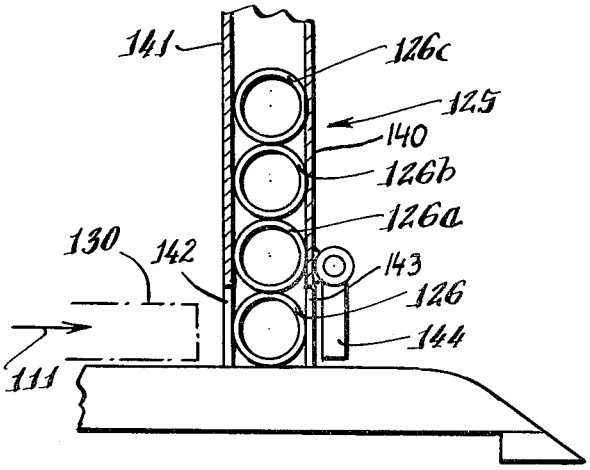
Fig. 5.
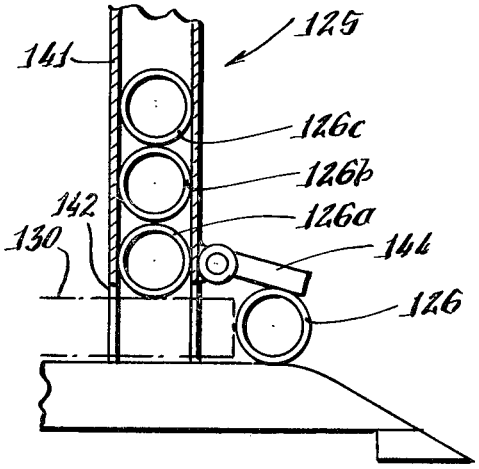
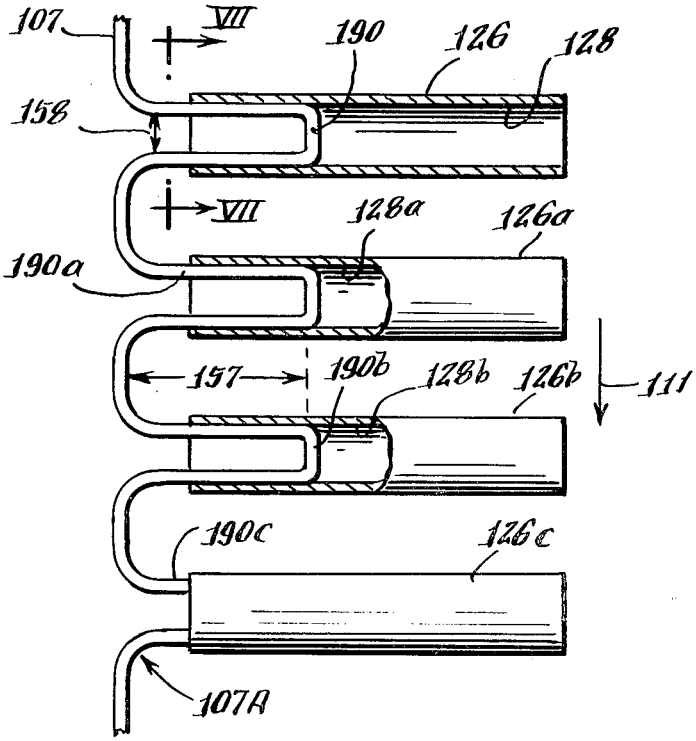
Fig. 8.
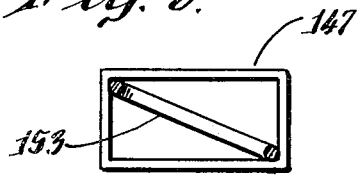
Fig. 9.
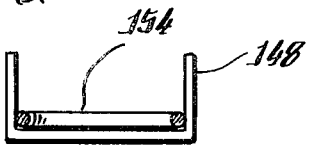
Fig. 10.
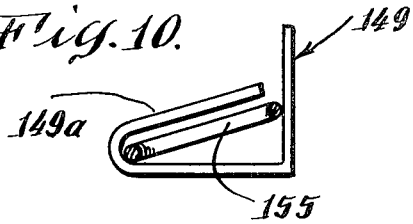
Fig. 6.
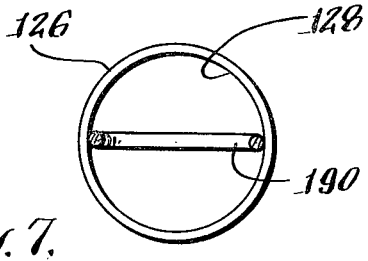
Fig. 7.
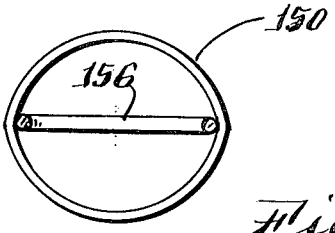
Fig. 11.

APPARATUS FOR LOOPING METALLIC WIRE OR THE LIKE

BACKGROUND OF THE INVENTION

The present invention relates to apparatus for deforming wire or like products, and more particularly to improvements in apparatus for looping a length of wire, strip, band, web or analogous flexible material (hereinafter called wire for short). Still more particularly, the invention relates to improvements in apparatus for looping a length of wire and (if desirable or necessary) for simultaneously inserting the loops into pockets or analogous cavities or recesses (hereinafter called pockets) of components which preferably consist of metal and can but need not constitute elements of electric circuits.

When a batch of metallic components is to be subjected to surface treatment, the components are normally or often mounted on loops of a length of wire in such a way that the loops extend into the pockets of the respective components. This holds especially true when the surface involves resort to an electric field. It was already proposed to utilize a metallic wire-like carrier of resilient material which is formed with a series of loops each capable of being inserted into the pocket of a discrete metallic component so that the carrier is in electric contact with and supports the components which form a file or row of spaced-apart commodities ready to be treated in any one of a number of different ways. The wire-like carrier is conductive, and its loops are dimensioned to fit snugly into the pockets of the respective components to thus ensure the establishment of reliable electrical connections.

Metallic components which can be treated in the just outlined manner can constitute or resemble simple or complex profiles, rings, tubes or otherwise configurated bodies each of which has at least one pocket (e.g., the central opening of a ring or the axial bore or passage of a tube). As a rule, the pockets of fully treated components are concealed from view. This is the reason that the loops of the wire-like carrier are inserted into the pockets because imperfect treatment of surfaces bounding the pockets is not detrimental. In other words, the fact or the possibility that the treatment will not affect (or will not affect to the same extent) each and every minute portion of the surface bounding a pocket will not adversely influence the utility and/or appearance of the finished product. The treatments to which metallic components whose pockets or analogous cavities receive loops of wire-like carrier are or can be subjected include various electrolytic techniques such as galvanizing, electrolytic polishing and/or anodic oxidation. Furthermore, the treatments can involve procedures which are carried out under normal atmospheric conditions, such as providing metallic components with sprayed-on coats consisting of lacquer or paint. Anodic oxidation of aluminum is also known as aluminite process and is carried out while the components are immersed into a suitable bath.

It was also proposed to replace the aforediscussed looped wire-like carrier with a metallic plate having protuberances in the form of mandrels each of which can be inserted into the pocket of a discrete metallic component. The plate must consist of an electrically conductive material and the establishment of electric contact is effected under the action of gravity, i.e., the weight of a metallic component is deemed to be sufficient to establish electric contact between the mandrel and the component even if the mandrel does not fit snugly into the pocket. Such mode of establishing electric contact is unreliable and normally requires careful cleaning of the surfaces of mandrels after each use. This will be readily appreciated since the mandrels undergo the same treatment as the metallic components so that, for example, at least some lacquer or paint is likely to deposit on the mandrels in the course of a particular treatment with the result that the establishment of electric contact with a fresh workpiece cannot be ensured unless the paint or lacquer is removed for each and every mandrel of the plate-like carrier.

OBJECTS AND SUMMARY OF THE INVENTION

An object of the invention is to provide a novel and improved apparatus for making a wire-like looped carrier for metallic components in a simple and time-saving operation.

Another object of the invention is to provide an apparatus wherein a length of wire can be converted into a carrier having identically configurated and equally spaced loops for retention of metallic components in the course of one or more surface treatments.

A further object of the invention is to provide a highly versatile apparatus which can be rapidly converted for the making of larger, smaller, wider, narrower, longer or shorter loops, and which can simultaneously insert successive freshly formed loops into the pockets of successive metallic or like components.

An additional object of the invention is to provide the apparatus with novel and improved means for properly guiding the wire and the ultimate product in a selected direction.

Another object of the invention is to provide a novel and improved method of converting a length of wire into a looped carrier for metallic components and of assembling such components with the wire-like carrier.

Still another object of the invention is to provide the apparatus with novel and improved means for supplying metallic or like components to the loop forming station for automatic introduction of successively formed loops into the pockets of successive components.

Another object of the invention is to provide an apparatus which can be used as a superior substitute for heretofore known apparatus serving to convert a length of wire into a looped or meandering wire-like carrier for metallic components.

A further object of the invention is to provide the apparatus with novel and improved means for changing the dimensions of loops and/or the extent of movement of parts which deform the wire and remove successive loops from the bending station.

The invention is embodied in an apparatus for converting a wire (such as a continuous wire-like electrical conductor) into a succession of coherent loops which are preferably spaced apart from one another and are connected to each other by webs of desired length), particularly for converting a wire-like electrical conductor into a substantially undulate body or carrier with loops which are insertable into the pockets of discrete metallic components so that the loops are in current-conducting contact with the respective components. The apparatus comprises a wire feeding device which includes means for intermittently advancing a length of wire along a predetermined path wherein the wire moves lengthwise in a predetermined direction, and a pair of spaced apart bending tools which are adjacent to one side of the path and define a gap across which the wire extends. One of the tools is disposed downstream of the other tool, as considered in the direction of lengthwise advancement of the wire, and the apparatus further comprises a reciprocable deforming device (such as an elongated blade, ram, bar or rod which is movable back and forth by a fluid-operated motor or the like) movable from the one side of the path into the gap between bending tools to thereby convert the adjacent portion of the wire into a loop which is disposed between the two tools, and means for intermittently moving the one tool to an inoperative position in which a freshly formed loop can be moved sideways in the direction of lengthwise advancement of the wire so that the feeding device or a pusher can place a fresh portion of the wire across the gap preparatore to the making of a fresh loop. The apparatus preferably further comprises a base or support for the bending tools, and such support preferably defines a substantially straight channel wherein the wire advances along its path. The support ensures that the wire cannot yield (except into the gap) when the deforming device performs a working stroke in a direction to deform that portion of the wire which extends across the gap.

The apparatus can further comprise a receptacle for discrete components. Such receptacle can be disposed at the other side of the path and can include means for maintaining the pocket of a component in register with the gap between the bending tools so that a loop which is formed in response to penetration of the deforming device into the gap from the one side of the path is compelled to enter the registering pocket of a component and can thereby establish electric contact between the wire and the component. The just discussed apparatus can further comprise stop means provided at the other side of the path for the wire and serving to hold the component, whose pocket registers with the gap, against movement with the deforming device during the making of a loop, i.e., during introduction of wire into the pocket which registers with the gap between the bending tools. The apparatus can further comprise intermittently operated means for moving successive components whose pockets register with the gap in the direction of movement of the wire along its path when the one tool assumes its inoperative position to thus provide room for entry of the pocket of a fresh component into register with the gap. The moving means can comprise a reciprocable pusher, and the receptacle can comprise a duct for a stack of aligned metallic components. The duct is preferably positioned to allow for gravitational descent of components which form the stack so that the lowermost component of the stack descends and moves its pocket into register with the gap in response to removal of the preceding component by the pusher and subsequent retraction of the pusher.

The duct preferably comprises a pair of side walls which flank the stack of components therein. That wall which is disposed upstream of the other wall, as considered in the direction of feeding of the wire, is formed with a first opening which permits the pusher to entre into engagement with the lowermost component of the stack, and the other wall has a second opening which registers with the first opening and allows a component whose pocket contains a freshly formed loop to leave the duct in response to a forward movement of the pusher.

The bending tools can comprise or constitute substantially cylindrical pins or studs, and the pin of the one bending tool can be moved axially to and from its inoperative position; for example, the pin of the one tool can be caused to descend into the aforementioned support when it is to assume the inoperative position so that a freshly formed loop can leave the bending station (i.e., its position of register with the deforming device) in response to actuation of the wire feeding means of the pusher.

The apparatus preferably further comprises means (e.g., a portion ofthe aforementioned support) for removably supporting the bending tools so that such tools can be replaced with otherwise configurated, dimensioned and/or positioned tools. Analogously, the apparatus can comprise a magazine (such as the aforementioned receptacle for discrete metallic components) and means for removably supporting the magazine in the apparatus so that the magazine can be replaced with a differently dimensioned and/or configurated magazine (e.g., with a duct containing larger, smaller or otherwise configurated metallic components).

Still further, the apparatus can be equipped with suitable means for selecting the extent of intermittent advancement of the wire along its path, i.e., with adjusting means for the pusher and/or the wire feeding device so that the latter can intermittently advance or supply longer or shorter increments of the wire. Also, the apparatus can be equipped with means for adjusting the stroke of the deforming device, i.e., for selecting the size of the loop which is formed when the deforming device performs a forward stroke to penetrate into the gap between the bending tools.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is an enlarged fragmentary sectional view as seen in the direction of arrows from the line IV—IV of FIG. 1;

FIG. 5 is a similar fragmentary sectional view but showing the pusher in the process of expelling a metallic component from the lower end of the duct for a stack of such components;

FIG. 6 is an enlarged plan view of a carrier constituting a piece of looped wire with certain of the metallic components shown in a fully or partly sectional view;

FIG. 7 is a sectional view as seen in the direction of arrows from the line VII—VII of FIG. 6;

FIG. 8 is an end elevational view of a modified metallic component with a loop of metallic wire in its pocket;

FIG. 9 is a similar end elevational view of a further metallic component;

FIG. 10 is a similar end elevational view of an additional metallic component; and FIG. 11 is a similar end elevational view of still another metallic component.

DESCRIPTION OF THE PREFERRED EMBODIMENTS

Figure 1:
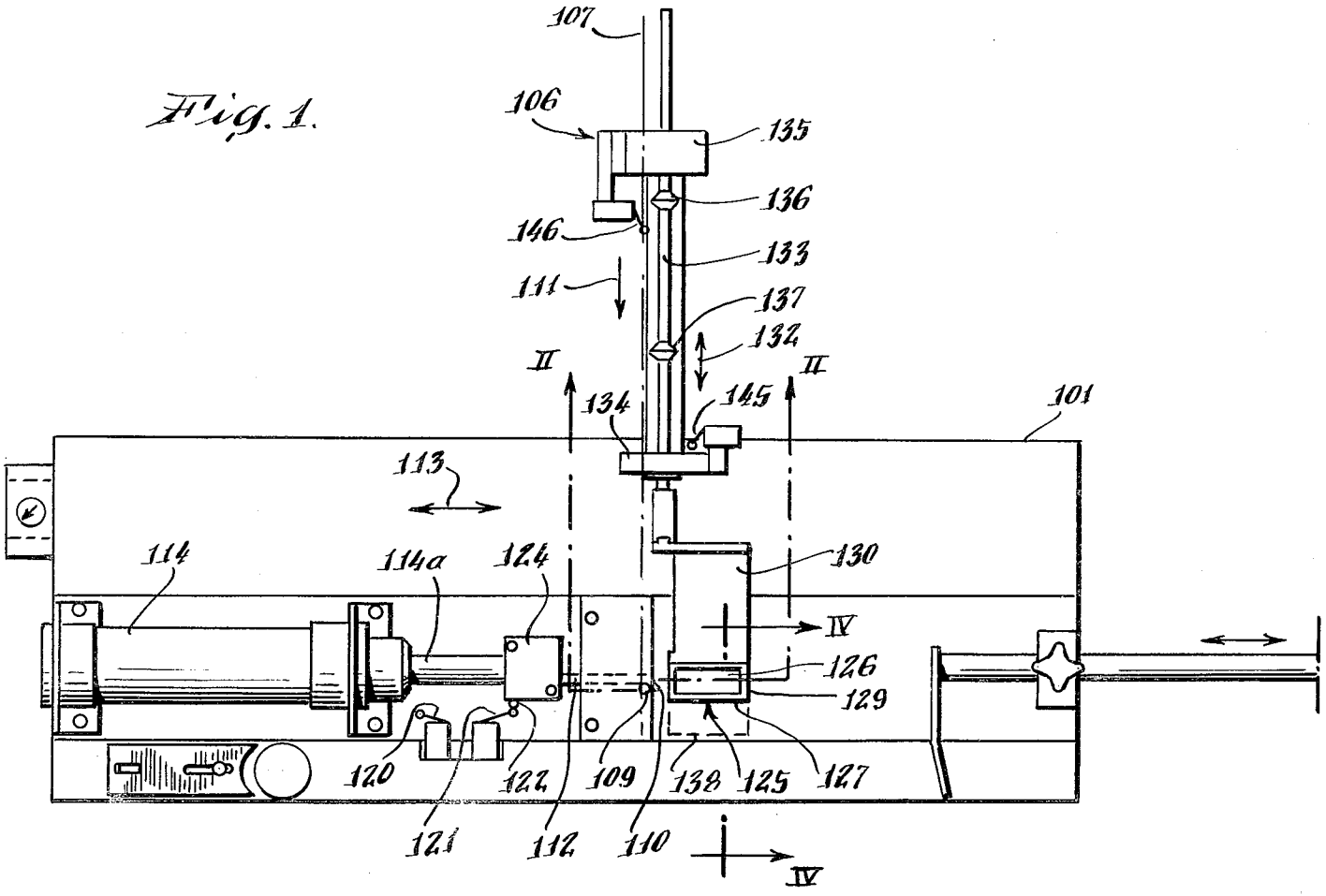
FIG. 1 is a somewhat schematic plan view of an apparatus which embodies one form of the invention.

The apparatus which is shown in FIGS. 1 to 6 comprises a support including a plate-like base 101 for a bending station 102 where successive increments of a length of wire 107 are converted into substantially U-shaped loops 190 (see particularly FIG. 6). The support further includes two plate-like holders 103, 104 which are secured to one another by bolts, screws or other suitable fasteners (see FIG. 3) and define a straight or substantially straight channel 100 at the left-hand side of the bending station 102. This channel constitutes a portion of an elongated path along which the wire 107 is advanced stepwise. The wire 107 is supplied by a wire feeding mechanism 106 the details of which form no part of the present invention. The wire 107 is made of or comprises a metallic material so that it constitutes an electric conductor.

The bending station 102 accommodates two parallel stud- or pin-shaped bending tools 108, 109 which are adjacent to the right-hand side of the channel 100, i.e., to the right-hand side of the path of intermittent movement of the wire 107 toward, through and beyond the station 102. The bending tools 108 and 109 define a gap 110 which is in register with a reciprocable elongated deforming device or ram 112. The directions in which the ram 112 is reciprocable into and away from the gap 110 between the bending tools 108, 109 are indicated by a double-headed arrow 113. The bending tool 109 (namely, the one which is located downstream of the tool 108, as considered in the direction of arrow 111) of lengthwise movement of the wire 107 in the channel 100) is movable from the operative position shown in FIG. 2 to a retracted or inoperative position (indicated in FIG. 2 by broken lines at 109') in which it cannot interfere with advancement of a freshly formed loop 190 in the direction of lengthwise advancement of the wire 107, i.e., in a downward direction, as viewed in FIG. 1. The means for intermittently moving the bending tool 109 to the inoperative position 109' comprises a motor 117 here shown as a fluid-operated (e.g., pneumatic) double-acting cylinder and piston unit. The tool 109 can constitute the piston rod of the unit 117 and can be retracted by the piston in the cylinder of this unit to a level at which its tip is disposed below the channel 100.

Figure 3:
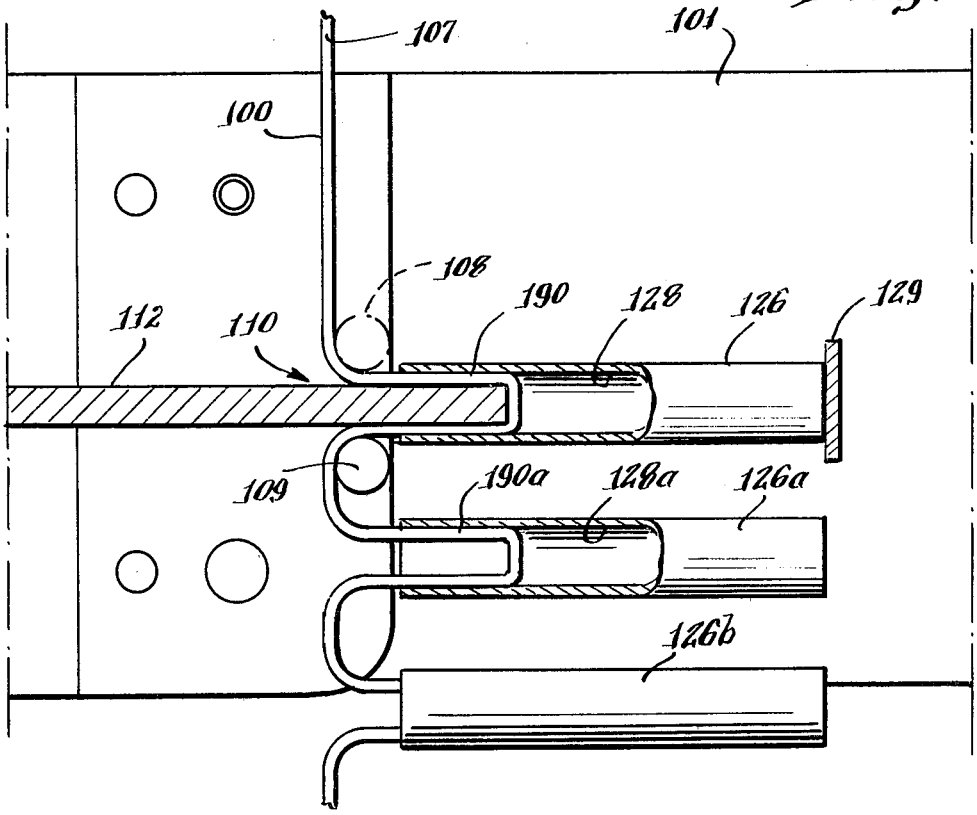
FIG. 3 is a sectional view as seen in the direction of arrows from the line III—III of FIG. 2.

The means for moving the deforming device or ram 112 in directions indicated by the arrow 113 comprises a fluid-operated (preferably hydraulic) motor 114 which is mounted on the base 101 to the left of the holders 103, 104, as viewed in FIG. 1, and can cause the ram 112 to perform forward strokes (toward and into the gap 110) at regular or irregular intervals in synchronism with movements of the wire 107 in the direction of arrow 111 (namely, when the wire 107 in channel 100 is not in motion) and in synchronism with movements of certain other parts of the apparatus. The holders 103, 104 further define a channel 115 wherein the ram 112 is reciprocable on its way into or during movement out of the gap 110. A portion of the channel 100 constitutes a passage for entry of the ram 112 into the gap 110. FIG. 3 shows the ram 112 in fully extended position in which the front end portion or leader of the ram maintains a freshly formed loop 190 in the pocket 128 of a metallic component 126 which is held at the right-hand side of the bending station 102 so as to maintain its pocket in register with the gap 110. When the ram 112 is fully retracted, its leader is located to the left of the bending tools 108, 109, as viewed in FIG. 3, so that the wire 107 can advance downwardly upon retraction of the tool 109 to the inoperative position 109'.

The extent of reciprocatory movements of the ram 112 can be selected or changed by an adjusting unit including two electric switches 120, 121 which are actuatable by a trip 122 on the ram 112 or on a part which shares the movements of the ram. The position of the trip 122 relative to the ram 112 and/or the positions of the electric switches 120, 121 relative to the holders 103, 104 (as considered in the directions indicated by arrow 113) can be changed to thereby select the length of strokes which the ram 112 performs. The forward movement of the ram 112 is arrested and the ram reverses the direction of its movement when the trip 122 engages the switch 121, and the ram 112 terminates its return stroke and begins to move forwardly when the trip 122 reaches and actuates the switch 120. The switches 120 and 121 are installed in the circuit of valve means which regulate the flow of hydraulic fluid into and from the chambers of the cylinder forming part of the motor 114. The manner in which such valve means are actuatable by signals generated on closing or opening of electric switches is notoriously old and need not be described here.

The piston rod 114*a* of the motor 114 supports a holder 124 which, in turn, detachably supports the ram 112. This enables an attendant to rapidly replace the illustrated ram with a differently dimensioned or configurated ram, e.g., to form loops of greater or lesser width upon replacement of the illustrated bending tools 108, 109 with two bending tools which define a gap having a width greater or less than that of the illustrated gap 110.

Figure 2:
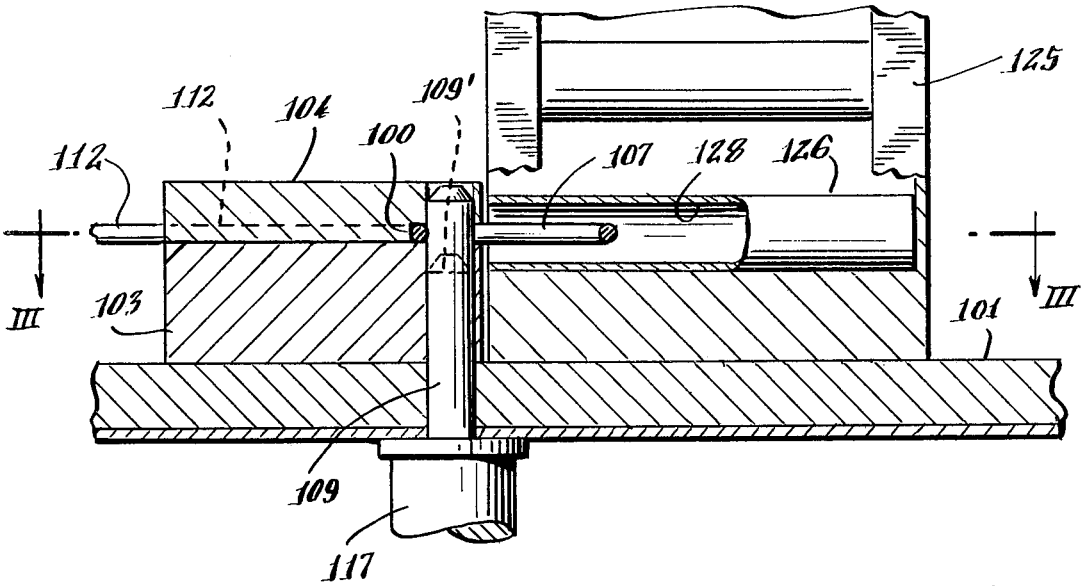
FIG. 2 is an enlarged fragmentary sectional view as seen in the direction of arrows from the line II—II of FIG. 1.

The apparatus further comprises a receptacle or magazine 125 which is adjacent to the path of stepwise advancement of the wire 107 at the right-hand side of the bending station 102, as viewed in FIG. 1, 2 or 3. The illustrated receptacle 125 can be said to constitute an upright duct which can receive a stack of superimposed metallic components 126 in such a way that the pocket 128 of the lowermost component 126 in the stack is in register with the gap 110. In FIG. 1, the duct 125 is cut away at a level above the lowermost component 126, namely, at a level above that component whose pocket 128 registers with the gap 110. The lowermost portion of the duct 125 can be said to constitute a socket 127 for the lowermost component 126 of the stack. A stop or abutment in the form of a plate 129 (which can form part of the duct 125 or can be mounted directly on the base 101) is provided to hold the lowermost component 126 of the stack in the duct 125 against movement with the ram 112 while the latter performs a working stroke, i.e., while the leader of the ram inserts a freshly formed loop 190 into the pocket 128 of the component 126 in the socket 127.

The means for moving successive lowermost components 126 in the direction of arrow 111 (upon retraction of the bending tool 109 to the inoperative position 109') comprises a reciprocable plate-like pusher 130 which is movable by a motor (not shown). The pusher 130 thereupon performs a return stroke so that the next component 126 in the duct 125 can descend into the socket 127, i.e., such component can assume a position in which its pocket 128 registers with the gap 110. The arrow 132 denotes the directions of reciprocatory movement of the pusher 130.

The apparatus also comprises means for selecting the length of forward and return strokes of the pusher 130, i.e., for determining the extent to which the wire 107 is advanced upon completion of a loop 122. To this end, the pusher 130 is coupled with a rod 133 carrying two trips 136, 137 for electric limit switches 146, 145 which are installed adjacent to the path of movement of the rod 133. The trips 136, 137 are adjustable lengthwise of the rod 133 and/or the switches 146, 147 are shiftable in and counter to the direction indicated by the arrow 111. The manner in which the switches 145, 146 control the operation of the moving means (not shown) in order to ensure that the pusher 130 will perform strokes of desired length is known in the art and need not be described here. The rod 133 is reciprocable in suitable bearings 134 and 135. The moving means can comprise a pneumatic, hydraulic or electric motor for moving the pusher 130 and the rod 133 in directions indicated by the double-headed arrow 132.

FIG. 1 shows the pusher 130 in its retracted position, i.e., at the upstream side of the duct 125. The extended position of the pusher 130 is shown in FIG. 1 by broken lines, as at 138. The upstream side wall 141 (see FIGS. 4 and 5) of the duct 125 has a first opening 142 which enables the leader of the pusher 130 to enter the socket 127 and to expel the lowermost component 126 in the direction of arrow 111. The downstream side wall 140 of the duct 125 has a second opening 143 which is large enough to allow a component 126 to pass therethrough and is normally closed by a pivotable flap 144. This flap yields when the lowermost component 126 (such component is coupled to a freshly formed loop 190 of the wire 107) is expelled from the duct 125 (i.e., from the socket 127) in response to movement of the pusher 130 from the solid line position to the broken line position 138 of FIG. 1.

The wire feeder 106 is used to advance the wire 107 prior to the making of the first loop or when the duct 125 is removed, i.e., when the apparatus is used exclusively to make a meandering carrier 107A whose loops **190, 190*a*, etc. are connected with discrete metallic components 126, 126*a***, etc. by hand or in a separate machine.

The operation is as follows:

The leader of the wire 107 is introduced into the channel 100 and the duct 125 is at least partially filed with a stack of identical metallic components 126. The tip of the leader of introduced wire 107 extends beyond the gap 110 and bending tool 109 through a distance which at least equals but can at least slightly exceed half the length of a loop 190. At such time, the tool 109 can be held in the inoperative or retracted position 109'. In the next step, the motors 114 and 117 are actuated so that the motor 117 lifts the tool 109 to the operative position which is shown in FIG. 2 by solid lines ahead of movement of the tip of the ram 112 into engagement with the wire portion extending across the gap 110. The ram 112 forms a loop 190 which immediately enters the pocket 128 of the lowermost component 126 in the stack, i.e., of the component in the socket 127 of the duct 125. The portion of wire which is forced into the adjacent pocket 126 to form a loop 190 rolls along the peripheral surfaces of the bending tools 108, 109 which can rotate about their respective axes. One half of the loop 190 in the pocket 126 is furnished by the wire which was advanced beyond the tool 109, and the other half is furnished by the wire in the channel 100 upstream of the bending station 102. The dimensions of the gap 110 and the ram 112 are selected in such a way that each freshly formed loop 190 is a snug fit in the respective pocket 126.

In the next step, the motors 114 and 117 respectively retract the ram 112 and the bending tool 109, and the motor 131 is actuated to move the pusher 130 from the solid-line position to the position 138 of FIG. 1 whereby the pusher expels the lowermost component 126 from the socket 127 and simultaneously advances the wire 107 along the path which is defined by the channel 100 so that a fresh portion of the wire 107 extends across the gap 110. The length of the forward stroke of the pusher 130 is preferably selected in such a way that there is no need to feed the wire 107 upon retraction of the pusher to the solid-line position of FIG. 1, i.e., the apparatus is then ready to make the next loop **190*a* (FIG. 6) which enters the pocket 128*a* of the component 126*a* in the socket 127. The component 126*a* descends into the socket 127 in immediate response to retraction of the pusher 130 to the solid-line position of FIG. 1. The making of the second, third, etc. loops 190*a*, 190*b*, etc. entails a certain rearward movement of the first, second, etc. loops 190, 190*a*, etc. in response to penetration of the ram 112 into the gap 110**.

If desired, the magazine or duct 125 can be omitted. The apparatus then converts the wire 107 into a meandering carrier 107A with a succession of coherent loops **190, 190*a*, 190*b*, 190*c*, etc. The components 126, 126*a*, 126*b*, 126*c***, etc. can be attached to such loops by hand or in a separate apparatus.

FIG. 6 shows a portion of the finished product, namely, a portion of the meandering wire or carrier 107A with four equidistant U-shaped loops **190–190*c* each of which extends into the pocket (128, 128*a*, 128*b* . . . ) of a discrete metallic component (128, 128*a*, 128*b*, 128*c*). As can be seen in FIG. 7, the components 126–126*c* are circular cylinders and the distance 158 (note FIG. 6) between the two parallel legs of each loop is selected in such a way that this distance, plus two diameters of the wire 107, at least matches the inner diameter of a metallic component. The length of each loop, i.e., the distance 157 (note FIG. 6) between the web of a loop and the wire portion between two neighboring loops can be varied by adjusting the forward stroke of the ram 112**.

If the operators wish to form loops of different sizes and/or shapes, the holders 103, 104 can be replaced with different holders which define a channel 100 of greater or smaller diameter and which can carry differently configurated, dimensioned and/or spaced-apart bending tools. The ram 112 is detached from its holder 124 and is replaced with a differently configurated or dimensioned ram which can form loops of desired size and/or shape. The duct 125 is then replaced with a duct which contains a stack of differently dimensioned and/or configurated metallic components. For example, FIG. 8 shows a metallic component 147 which has a polygonal outline and wherein the loop 153 extends diagonally. FIG. 9 shows a component 148 having a substantially U-shaped cross-sectional outline and receiving a loop 154 which is adjacent to the lower part of its side wall. FIG. 10 shows a component 149 having a substantially d-shaped cross-sectional outline and receiving a loop 155 which slopes along the inner side of the wall 149*a*. FIG. 11, finally, shows a component 150 having a substantially oval cross-sectional outline; the loop 156 extends along the major axis of the ellipse.

The following table shows the changes which must be carried out in order to make a product which deviates from the product shown in FIG. 6:

| Embodiments: | FIG. 6 | First Modification | Second Modification | Third Modification |
|---|---|---|---|---|
| Material of the wire 107 | hard aluminum | iron | cooper | hard aluminum |
| Diameter of the wire | 4 mm | 6 mm | 6 mm | 4 mm |
| Distance 157 (note FIG. 6) | 50 mm | 80 mm | 60 mm | 100 mm |
| Distance 158 (note FIG. 6) | 20 mm | 35 mm | 25 mm | 20 mm |
| Material of the metallic component | aluminum | iron | iron | aluminum |

An important advantage of the improved apparatus is that it can produce a wire-like carrier and assemble the loops of the carrier with discrete metallic components in a simple and time-saving manner. While the components can be attached to the loops in a separate operation, the illustrated apparatus exhibits the advantage that the making of loops and the insertion of freshly formed loops into the pockets of successive components can take place simultaneously with attendant savings in space, time and machinery or manual work.

Another important advantage of the improved apparatus is that the establishment of electric contact between the loops of the wire-like carrier and the metallic components takes place automatically and that the contact is reliable since the dimensions of the loops can be readily selected in such a way that their insertion into the pockets of successive metallic components automatically entails the establishment of a reliable current-conducting connection. The loops normally exhibit at least some tendency to expand (i.e., to increase the distance 158 shown in FIG. 6) which evidently enhances the establishment of satisfactory electric contact with the metallic components. This holds true even if the surface of the wire 107 is partially coated with impurities, e.g, if the carrier shown in FIG. 6 is reused and its loops are, or might be, partially covered with paint or lacquer prior to insertion into the pockets of a further set of metallic components. The carrier is surprisingly inexpensive because the apparatus for its manufacture is simple and compact so that it is normally or frequently worthwhile to consider the carrier an expendable item which is discarded after a single use. In many instances, cleaning of a previously used carrier involves relatively high costs which may warrant disposing of a used carrier and making a fresh carrier for each batch of metallic components.

If the carrier is to be reused, all of its portions are readily accessible to liquid in a pickling bath or a like medium which is used to clean the loops prior to insertion into the pockets of a fresh set or batch of metallic components. The liquid can be used to remove (e.g., dissolve) particles of paint, lacquer, rust or other substances which develop or deposit on the loops while a set of metallic components is treated in one or more of the aforedescribed ways. The treatment can be repeated twice or more than twice, i.e., the carrier can be reused more than once as long as the dimensions of the loops still suffice to establish reliable electric contact with successive sets of metallic components. The resiliency of the material of the wire 107 can be readily selected in such a way that the width of a loop suffices for satisfactory engagement with the surface surrounding the pocket of a metallic component even if the diameter of the wire has decreased appreciably after two or more treatments in a pickling bath or another corrosive substance.

Since the wire 107 preferably consists of a material which exhibits at least some resiliency, its loops can be readily deformed during insertion into the pockets of metallic components to thereupon expand and thus ensure reliable retention of the components as well as highly reliable electric contact with the material of the components. All that is necessary is to deform the loops in such a way that their legs make an oblique angle during insertion into the pockets of metallic components or during extraction of loops from the respective pockets. In other words, it is desirable to make the carrier in such a way that the angle between the legs of its loops is greater when the loops are exposed than when the loops are confined in the pockets of metallic components.

It has been found that the improved apparatus can be used with particular advantage in connection with the treatment of metallic components which consist of or contain aluminum, such as aluminite treatment of aluminum or aluminum alloys. In order to avoid electrolytic stresses, one normally resorts to a wire which consists of aluminum. In order to ensure that an aluminum wire exhibits the required stiffness and resiliency, such wire is preferably made by resorting to a hard-drawing technique.

In order to store the improved carrier, it is advisable to place several lengths of carrier, made from one and the same continuous wire, next to one another so that the loops of the neighboring lengths overlie each other, and to wind the lengths onto the core of a reel in such a way that the axis passing through the center of curvature is parallel to the planes of the loops, i.e., the loops are bent about axes which are parallel to their respective planes.

The metallic components which have undergone an electrolytic or other treatment while supported by the loops of the wire-like carrier can be detached from or left on the respective loops, e.g., for the purpose of convenient storage, and/or transport to locales of use or to customers. Thus, the treated components can remain on the loops of the wire-like carrier during the entire period of storage or shipment and all the way to the locus of actual use. In fact, some of the components can remain on the carrier while the other components are being, or after the other components have been, removed for actual use in the electrical, chemical or any other industry.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting a length of wire into a succession of coherent loops and inserting said loops into pockets of discrete metallic components, particularly for converting a wire-like electrical conductor into an undulate body with loops which are insertable into said pockets, comprising a wire feeding device arranged to intermittently supply a length of wire along a predetermined path wherein the wire moves lengthwise in a predetermined direction; a pair of spaced-apart bending tools adjacent to one side of said path and defining a gap across which the wire extends, one of said tools being downstream of the other tool, as considered in said direction; a reciprocable deforming device movable from said one side of said path into said gap to thereby convert the adjacent portion of the wire into a loop which is disposed between said tools and to insert said loop into said pockets; and means for intermittently moving said one tool to an inoperative position in which a freshly formed loop can be advanced in said direction.

2. The apparatus of claim 1, further comprising a support for said tools, said support defining a substantially straight channel wherein the wire advances along said path.

3. The apparatus of claim 1, further comprising a receptacle for discrete components, said receptacle being disposed at the other side of said path and including means for maintaining the pocket of a receptacle in register with said gap so that a loop which is formed in response to movement of said deforming device into said gap is compelled to enter the pocket of such component.

4. The apparatus of claim 3, further comprising stop means provided at said other side of said path to hold a component whose pocket registers with said gap against movement with the deforming device during the making of a loop.

5. The apparatus of claim 3, further comprising intermittently operated means for moving the components whose pockets register with said gap in said direction in the inoperative position of said one tool so as to provide room for entry of the pocket of a fresh component into register with said gap.

6. The apparatus of claim 5, wherein said moving means comprises a reciprocable pusher and said receptacle includes a duct for a stack of components.

7. The apparatus of claim 6, wherein said duct is positioned to allow for descent of components therein by gravity so that the lowermost component of the stack descends and moves its pocket into register with said gap on removal of the preceding component.

8. The apparatus of claim 7, wherein said maintaining means comprises a pair of side walls flanking the stack of components in said duct, one of said walls being disposed upstream of the other of said walls, as considered in said direction, and having a first opening for admission of said moving means into engagement with the component whose pocket registers with said gap, the other of said walls having a second opening through which the component whose pocket contains a freshly formed loop can be expelled from said duct.

9. The apparatus of claim 1, wherein said tools include substantially cylindrical pins and the pin of said one tool is movable axially to and from said inoperative position.

10. The apparatus of claim 1, further comprising means for removably supporting said tools so that such tools can be replaced with otherwise configurated, dimensioned and/or positioned tools.

11. The apparatus of claim 1, further comprising a receptacle for a supply of components and means for supporting said magazine in such position that one of the components therein maintains its pocket in register with said gap, said magazine being detachable from said supporting means so that it can be replaced with a magazine containing differently configurated and/or dimensioned components.

12. The apparatus of claim 1, further comprising means for selecting the extent of intermittent advancement of wire in said direction.

13. The apparatus of claim 1, further comprising means for adjusting the stroke of said deforming device.

* * * * *